United States Patent [19]

Longmore

[11] 4,282,942

[45] Aug. 11, 1981

[54] UNDERREAMER WITH PORTED CAM SLEEVE UPPER EXTENSION

[75] Inventor: Thomas L. Longmore, Long Beach, Calif.

[73] Assignee: Smith International Inc., Newport Beach, Calif.

[21] Appl. No.: 51,684

[22] Filed: Jun. 25, 1979

[51] Int. Cl.[3] ..... E21B 10/33

[52] U.S. Cl. ..... 175/269; 175/65

[58] Field of Search ..... 175/267–269, 175/213, 215, 271

[56] References Cited

U.S. PATENT DOCUMENTS

| | | | |
|---|---|---|---|
| 3,406,769 | 10/1968 | Kammerer | 175/269 |
| 3,757,877 | 9/1973 | Leathers | 175/269 |
| 4,187,920 | 2/1980 | Johnson | 175/267 |

*Primary Examiner*—Ernest R. Purser

*Attorney, Agent, or Firm*—Christie, Parker & Hale

[57] ABSTRACT

A borehole underreamer, having an axial flow passage from end to end and useful with reverse circulation operations, has a cutter arm actuator which includes an axially movable tube. The tube carries an annular piston which moves in an annular piston chamber formed about the tube. The tube is driven, to open the underreamer, by air pressure supplied to the piston chamber via a double-walled drill pipe. An upper extension of the tube above the piston is removable from the remainder of the tube and defines reverse circulation air injection ports which are opened from the chamber to the axial flow passage when the underreamer is open but which are sealed from the chamber when the underreamer is closed. The extension may be replaced by a similar ported extension to adapt the underreamer to different reverse circulation conditions, or it may be replaced by a similar unported extension to adapt the underreamer for use in conventional circulation operations.

14 Claims, 7 Drawing Figures

UNDERREAMER WITH PORTED CAM SLEEVE UPPER EXTENSION

BACKGROUND OF THE INVENTION

1. Field of the Invention

This invention pertains to subsurface borehole underreamers. More particularly, it pertains to underreamers especially suited for use with reverse circulation.

2. Prior Underreamers and Their Problems

A subsurface borehole underreamer is a tool which is used to enlarge a portion of the length of a hole drilled in the earth below a restriction in the hole. Such tools are used in drilling oil, gas, water, mining, and construction holes and wells, and also in the formation of shotholes for blasting. They are also used in reworking previously drilled oil wells. An underreamer has two operative states, a collapsed or closed state in which the tool diameter is sufficiently small to allow it to be moved in the hole past the restriction, and an opened or expanded state in which the diameter of the tool corresponds to the desired greater diameter to which the hole is to be enlarged below the restriction. As the tool is opened, one or more arms, hinged to the tool body and carrying suitable cutters, pivot out from the body to position the cutters for enlargement of the hole as the tool is thereafter operated; such operation includes rotating the tool and lowering it as it is rotated.

Underreamers are now of two general types, the so-called rock-types and drilling types. Rock-type underreamers are used where the entire length of the borehole, at least over the length thereof to be underreamed, has previously been drilled. Rock-type underreamers have large cutters which extend in the body to its center when the tool is closed; in such tools it is not required that a circulating fluid (air or a suitable liquid) flow axially through the tool from end to end. In drilling-type underreamers, on the other hand, it is required that a circulating fluid flow from end to end of the tool when it is opened. Drilling-type underreamers, therefore, use smaller cutters which, when the tool is closed, do not fully extend to the center or axis of the tool, thereby providing room in the tool for the definition of a circulating fluid duct past the retracted position of the cutters. In a drilling-type underreamer, the cutters are located between the exterior of the circulation duct and the exterior of the tool body when the tool is closed. Rock-type underreamers, therefore, enable a hole of given diameter to be enlarged to a greater diameter than do drilling-type underreamers due to the fact that they incorporate larger cutters within the interior of the tool body than a drilling-type underreamer.

A drilling-type underreamer usually is used in conjunction with a drill bit below the underreamer. The underreamer is a lower component of a string of rotary drill pipe, and the drill bit is carried at the lower end of the string. The drill bit forms the hole to be underreamed at the same time that the underreamer enlarges the hole formed by the bit. Circulation of fluid must be provided to the drilling bit to remove cuttings created by the bit as it is operated.

The advantages of existing rock-type underreamers are that they enable the use of the largest possible cutters within the confines of the tool body, and they afford maximum expanded diameter for a given size of the tool body; their disadvantages are that they provide no communication of circulating fluid below the tool, no direct fluid wash is provided to the cutters as they are operated, and it is not possible to use hydraulically or non-hydraulically actuated tools below such underreamers. The advantages of drilling-type underreamers are that they provide fluid communication below the tool, they enable the provision of a fluid wash on the underreamer cutters, and they enable the use of hydraulically or non-hydraulically actuated tools in the drill string below the underreamers; their disadvantages are that, for a given tool size, they can accommodate within the confines of the tool body only smaller cutters, and, therefore, their expanded diameter is limited as compared to rock-type underreamers.

Fluid Circulation Techniques

In the drilling of oil wells, two different fluid circulation techniques are used. The most commonly used technique is called "conventional circulation", and the other is called "reverse circulation". In conventional circulation operations, a hollow drill string is used to conduct circulation fluid down the drill string, out through the drill bit, and back up the hole formed by the drill bit. As the circulation fluid flows through and past the drill bit, it carries cuttings, formed by operation of the drill bit, away from the bit and back up the hole to the drilling rig where cuttings are separated and the fluid is reused. In conventional circulation, the fluid usually used is a water-based slurry of Bentonite and other additives. The Bentonite is used in the form of a finely divided powder, and the slurry is called "drilling mud". As the drilling mud circulates back up the drilled hole, it tends to enter into the earth formation being drilled. As this occurs, the formation acts to filter the Bentonite particles out of the water carrier, thus forming a cake of Bentonite and other particles on the walls of the drilled hole. This cake tends to close off the hole from the formation. If the hole is to be used as a part of an oil well, e.g., the cake impedes the flow of oil from the formation into the well, the result is a well which produces less oil than if the cake were not present along the walls of the drilled hole and in the formation immediately adjacent the hole.

Because of the adverse effects of drilling mud cake on the walls of holes drilled as oil wells, those concerned with the drilling, completion and operation of oil wells are beginning to use underreamers both in the completion of newly drilled oil wells and in the overhauling (workover) of previously drilled wells. This underreaming is being done using reverse circulation techniques.

Reverse circulation commonly involves the use of a double-walled drill pipe (drill string) and water as the circulation fluid. Water is circulated down the annular space between the drill string and the well bore, inwardly through and past the drill bit or other cutting tool (such as an underreamer), and up the drill string. The flow up the drill string occurs through an axial flow passage along the string. Such flow is initiated and maintained by the injection of compressed air into the water column in the string. The air is injected, in present practice, at the bottom of the drill string above the location of the cutting tool; the air rises in the axial passage and induces an upward flow of the circulation fluid and cuttings in that passage. The air is supplied via an annular passage in the drill string formed between the inner and outer walls of the double-walled drill string. Because the circulation fluid is water, without Bentonite, there is no build-up of a cake on the borehole walls. Thus, reverse circulation underreaming can be and is being used to advantage to strip accumulations of cake from the walls of oil wells drilled using conventional circulation techniques. In newly drilled wells, this is done as a last step in the formation of the well before completion of the well is begun. In existing wells, such underreaming is done as an effective and inexpensive way to rework and improve the well to obtain greater production of oil from the well.

In practicing reverse circulation, air is injected into the water column in the drill string at a controlled rate which is determined with regard to several factors, a major one of which is the hydrostatic pressure of the column at the location of injection. Such pressure is, in turn, determined by the height of the water column above such point. Other factors include the pressure of the air being injected, which pressure must be greater than the hydrostatic pressure. Because of all of these factors, the total area of the openings through which air injection occurs must be carefully selected with relation to the depth of the hole being drilled or underreamed at any given time. Generally, the deeper the hole, the smaller the total area of the air injection ports for a given mass flowrate of air.

If a drilling contractor is to be able to handle a wide range of reverse circulation underreaming operations, he must stock an inventory of different bottom sections (joints) of double-walled drill pipe, each joint having air injection openings of different total area. Double-walled drill pipe is significantly more costly than the single passage drill pipe used with conventional circulation. The maintenance of such inventories by drilling contractors is burdensome and inefficient.

Underreamer Rental

The present and established practice in the oil and gas drilling industry is for drilling contractors, the firms which actually drill and complete such wells, not to maintain an inventory of all of the drill bits, underreamers and other specialized and costly tools which they may need from time to time in the conduct of their businesses. Instead, as the need arises for a particular tool, the drilling contractor rents or leases the tool from a manufacturer of the particular type of tool. The tool manufacturers are much better able to economically and efficiently establish and maintain a suitable inventory of tools. This is the case with underreamers which are large, complex and expensive mechanisms.

The Need Presented

In view of the foregoing considerations, it is seen that a need exists for an underreamer which is readily useful with reverse circulation techniques and which possesses a combination of features including the advantages of rock-type and drilling-type underreamers with none of the disadvantages of either type, and the ability to accomplish reverse circulation air injection in the underreamer rather than in the bottom joint of a double-walled drill string. If the reverse circulation air injection can be accomplished in the underreamer, the drilling contractors are relieved of the need to maintain an inventory of double-walled drill string bottom joints.

SUMMARY OF THE INVENTION

This invention is addressed to the need identified above. It provides a borehole underreamer in which reverse circulation air injection can be effected within the underreamer, and in which the advantages of both rock-type and drilling-type devices can be provided without the disadvantages of either type. The air injection features are provided in the underreamer in a part of the mechanism which is readily removable from the mechanism, and which is small and inexpensive. This characteristic enables the underreamer manufacturer to establish and maintain for rental or lease an inventory of underreamers suited for a wide range of reverse circulation situations in a most economical and efficient manner. The manufacturer can stock a few complete underreamers, each of which can be adapted quickly and inexpensively to a specific reverse circulation problem by inserting into an underreamer the one of several parts which defines the appropriate air injection ports. The underreamer can also be used for conventional circulation operations if desired. Thus the present invention enables an already versatile underreamer to be made even more versatile and capable of serving in an increased variety of uses. The present invention is simple, effective and efficient, and its benefits are important, even synergistic, in effect.

Generally speaking, this invention provides a borehole underreamer which includes a tubular body adapted at an upper end thereof for coaxial connection to a rotary drill string. Cutter means are mounted to the body for motion relative to the body between retracted and opened positions respectively inside and outside the outer diameter of the body. A cutter means actuator includes a tubular element having an open upper end and at least one opening to the interior thereof at a location therealong below its upper end thereof for flow of circulation fluid through the opening during use of the underreamer. The tubular element is movable coaxially in the body between upper and lower positions which correspond to the retracted and opened positions of the cutter means. The upper end of the tubular element is slidable in an axial bore in the body above an annular chamber formed about the element. The chamber is so defined that the outer surface of the tubular element defines at least a portion of the inner wall of the chamber. A piston face is carried by the tubular element in the chamber below the upper end of the tubular element. Duct means in the body have lower ends opening to the chamber and upper ends opening above the upper end of the tubular element in the upper position thereof for communicating to the chamber and to the piston face actuation fluid pressure applied in use of the underreamer to the upper end of the body via a drill string. Port means of selected total area are defined through the tubular element at such location therealong relative to the piston face that the port means are closed from the chamber when the element is in its position corresponding to the retracted position of the cutter means; the port means communicate from the interior of the element of the chamber when the element is in its position corresponding to the opened position of the cutter means.

DESCRIPTION OF THE DRAWINGS

The above-mentioned and other features of this invention are more fully set forth in the following detailed description of the presently preferred embodiment of the invention, which description is presented with reference to the accompanying drawings, wherein:

FIG. 1 is comprised of FIGS. 1A and 1B which, when considered in serial arrangement with FIG. 1A to the right, and FIG. 1B to the left, show the illustrated underreamer in its two operative states, namely, in its closed state below the center line of the underreamer and in its open state above the center line;

DESCRIPTION OF THE ILLUSTRATED EMBODIMENTS

Figures 1A, 1B:
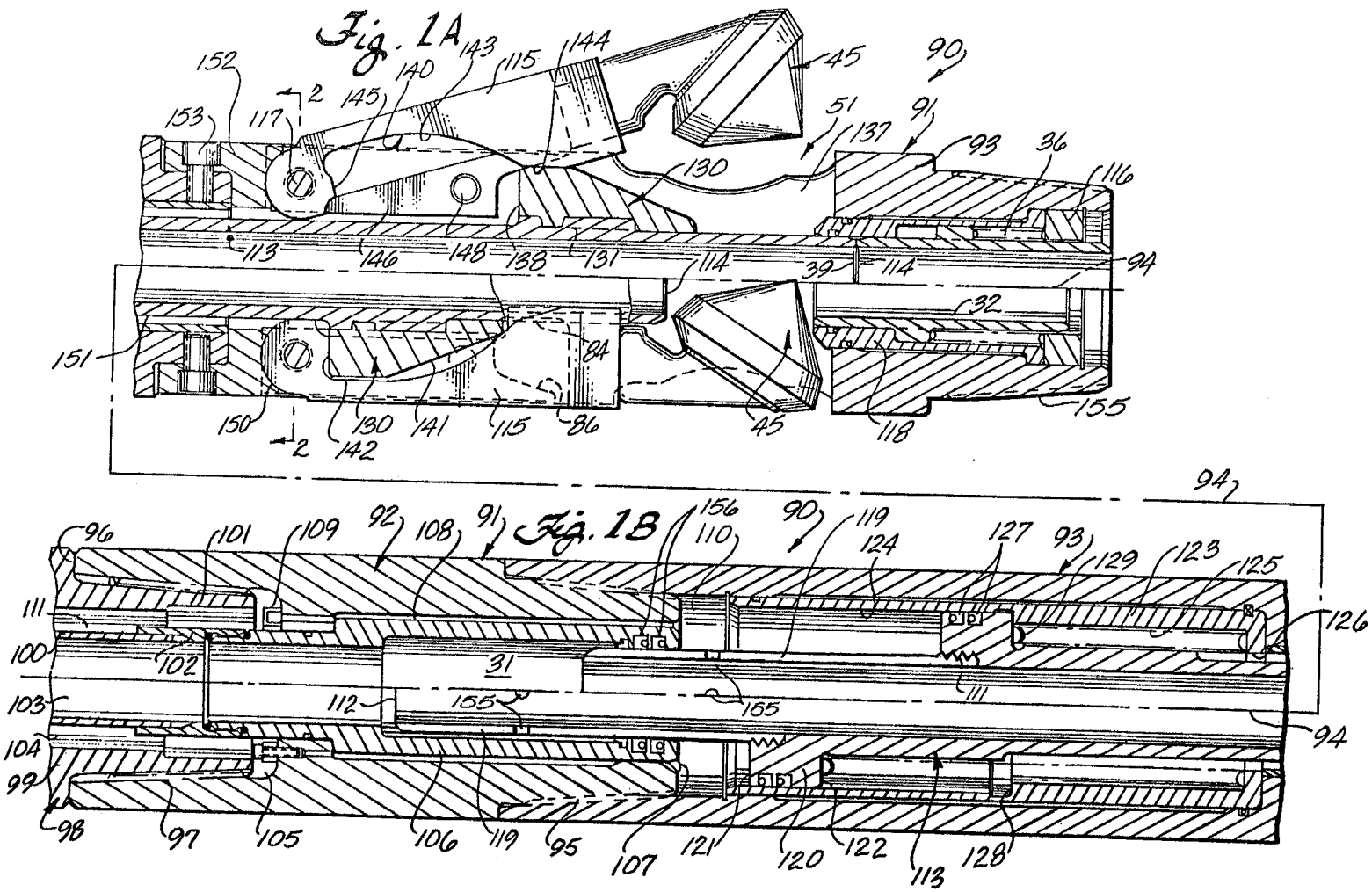
FIG. 1 is a cross-sectional elevation view of an underreamer according to this invention.

As shown best in FIGS. 1A and 1B, an underreamer 90 has an elongate, hollow tubular body 91 which is composed of a tubular reverse circulation cross-over sub (subassembly) 92 at the upper end of the body, and a piston and arm sub 93 defining the major lower part of the body. In FIG. 1, the underreamer is shown above axis 94 in its open or expanded state, and is shown in its closed or retracted state below axis 94. Subs 92 and 93 have equal outer diameters and are threaded together coaxially of underreamer axis 94 at their lower and upper ends, respectively, by a thread 95. The upper end 96 of cross-over sub 92 is internally threaded to define a box component of a pin and box threaded connection 97 which adapts the underreamer at its upper end to be connected coaxially to a cooperating pin component of the connection defined at the lower end of a string of double-wall reverse circulation drill pipe 98. Reverse circulation drill pipe 98 is of a commercially available type and includes an outer, heavy-walled torque transmitting pipe 99 at the lower end of which the pin component of connection 97 is defined. Pipe 98 also includes a smaller diameter coaxially disposed thin-walled inner tube 100 which is held relative to the outer pipe by spacer lugs which extend radially inwardly from the outer pipe at spaced locations along the length of each joint of the double-wall pipe. A sealing sleeve 102 is carried by the lower end of inner tube 100. The outer diameter of tube 100 is less than the inner diameter of outer pipe 99 so that reverse circulation drill pipe 98 defines therein a central axial fluid flow passage 103 along the interior of tube 100 and an outer annular fluid flow passage 104 between tube 100 and pipe 99. Each sealing sleeve 102 is adapted to cooperate with the adjacent ends of tubes 100 in adjacent lengths (joints) of drill pipe 90 in a drill string composed of plural lengths of such pipe. Accordingly, fluid present in annular flow passage 104 is communicated from length to length of the drill pipe and, as shown in FIG. 1, to an annular chamber 105 defined in cross-over sub 92 adjacent to the base of the internal threads defined by it at its upper end.

Chamber 105 is provided circumferentially with a tubular seal and piston support sleeve 106 which is secured within the cross-over sub body, as by weldments 107. A plurality of fluid flow duct passages 108, one of which is shown in FIG. 1B, are provided in the cross-over sub between chamber 105 and the opposite end of the sub. These passages extend generally parallel to the axis of the sub at selected locations angularly about the sub axis. Each passage 108 has an inlet end to chamber 105. The inlet end of each flow passage is fitted with a suitable filter 109 to prevent the entry of particulate matter into the passage. The other ends of passages 108 connect to a piston chamber 110 which is defined at the upper end of piston and arm sub 93.

Double-wall drill pipe 98 as shown in FIG. 1B may be a component of a Duo-Tube Airlift Drilling System, such as is marketed by Drilco Industrial Division of Smith International, Inc.

Figure 2:
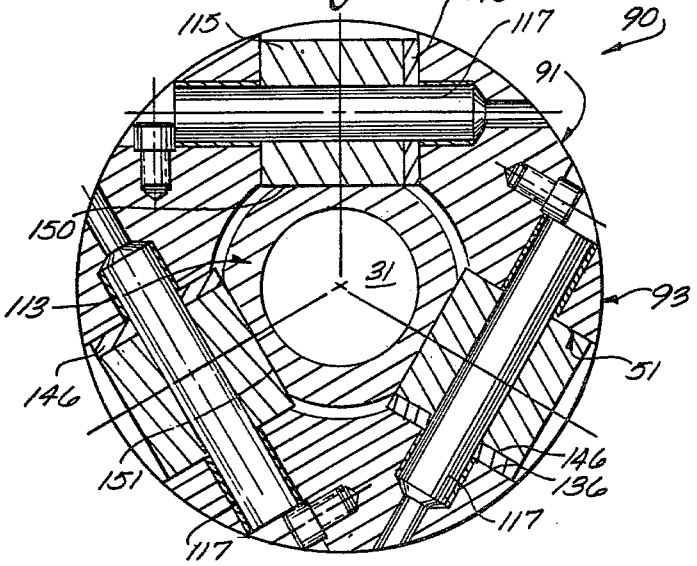
FIG. 2 is a cross-section view taken along line 2—2 in FIG. 1.

Underreamer 90, according to this invention as shown in FIGS. 1 and 2, may have an outer diameter of 7.25 inches and an overall length between its upper and lower ends 20 and 12 of 9 feet 5.75 inches.

The bore of piston support sleeve 106 defines an upper portion of an underreamer axial flow passage 31 which extends from end to end of the underreamer. Piston support sleeve 106 has a relatively smaller diameter bore section at its extreme upper end corresponding to the inner diameter of tube 100 of the double-wall drill pipe, and it has a relatively larger diameter bore portion at its lower end within which cooperates the upper end of an elongate open-ended hollow tubular cam sleeve 113. The tubular cam sleeve is disposed within body 91 concentrically about axis 94 and is slidably movable along the length of the underreamer relative to the body. The cam sleeve is hollow and is open at its upper and lower ends. The upper end 112 of the cam sleeve is always directed associated with the axial bore through support sleeve 108, and the lower end of the cam sleeve is always associated with a lower portion of the arm sub.

The cam sleeve 113 has a lower end 114 which, in the closed state of the underreamer, is disposed above the nested, "home", or stored position of a plurality of cutter elements 45 carried on the lower ends of a corresponding plurality of cutter support arms 115, the upper ends of which are pivotally connected to the body of piston and arm sub 93 by hinge pins 117 (see FIG. 1). When the cam sleeve is in its lower actuated position, corresponding to the open or expanded state of the underreamer, the lower end 114 of the cam sleeve is disposed below the "home" positions of cutter elements 45 and cooperates with the upper end 39 of a seal protector sleeve 32 disposed coaxially in the lower end of the piston and arm sub 93. The inner and outer diameters of the lower end of cam sleeve 113 and of seal protector sleeve 32 are equal.

The seal protector sleeve is biased upwardly in the underreamer by bias spring 36 which is disposed circumferentially of the sleeve and which is engaged at its upper end with a circumferential collar formed on the exterior of the sleeve and at its lower end with a spring retainer ring 116 held in position in the lower end of the sub by a suitable split retainer ring. The bias spring 36 and the collar of sleeve 32 are disposed in a large diameter portion of a bore in a holder sleeve 118, the upper end of which has an inner diameter cooperating closely with the outer diameters of sleeve 32 and cam sleeve 113. When the underreamer is in its closed condition and the cam sleeve is at its upper limit of travel in the underreamer body, seal protector sleeve 32 has its upper end substantially registered with the upper end of sleeve 118. However, when the cam sleeve is at its lower limit of travel in the underreamer, its lower end is engaged in the upper end of sleeve 118, thereby to provide communication between the upper and lower portions of underreamer axial flow passage 31.

A piston 120 is defined integrally with cam sleeve 113 circumferentially about its exterior. The extreme upper end portion of the cam sleeve, between the piston and the upper end 112 of the cam sleeve, is defined by a tubular member 119 which is removably connected to the remainder of the cam sleeve which defines the piston. Member 119 is a cam sleeve extension. The upper end of the cam sleeve extension is always engaged in the larger diameter portion of the axial bore in sleeve 106. The inner diameter of the cam sleeve extension is equal to the inner diameter of the remainder of the cam sleeve. The removable connection of the cam sleeve extension to the cam sleeve is accomplished, for example, by a threaded connection 111.

Piston 120 has upper and lower faces 121 and 122, the the upper face effectively defining the lower end of piston chamber 110. The piston reciprocates in a piston cylinder sleeve 123 which has a relatively larger diameter bore 124 axially thereof at its upper end, a relatively intermediate diameter bore 125 in its lower portion, and a relatively smaller diameter bore 126 at its extreme lower end. Bore 124 has a diameter corresponding to the diameter of piston 120. The piston is effectively sealed to bore 124 by suitable seals 127. The cylinder sleeve is held axially in position in the underreamer body against an upwardly facing shoulder with which the lower end of the cylinder sleeve is engaged, and by a suitable retainer ring which cooperates with the upper end of the sleeve. Piston chamber 110 is defined by body 91 and by the piston cylinder sleeve. The piston chamber is so defined that the inner walls of the annular piston chamber are formed by the outer wall of the cam sleeve extension.

An upwardly facing shoulder 128 is defined by sleeve 123 between bores 124 and 125. Engagement of piston lower face 122 with shoulder 128 defines a stop which limits downward movement of cam sleeve 13 in the underreamer. The cam sleeve is biased upwardly in the underreamer by a piston bias spring 129 which is engaged between the piston lower face and the upwardly facing shoulder defined by the cylinder sleeve between bores 125 and 126.

Figure 4:
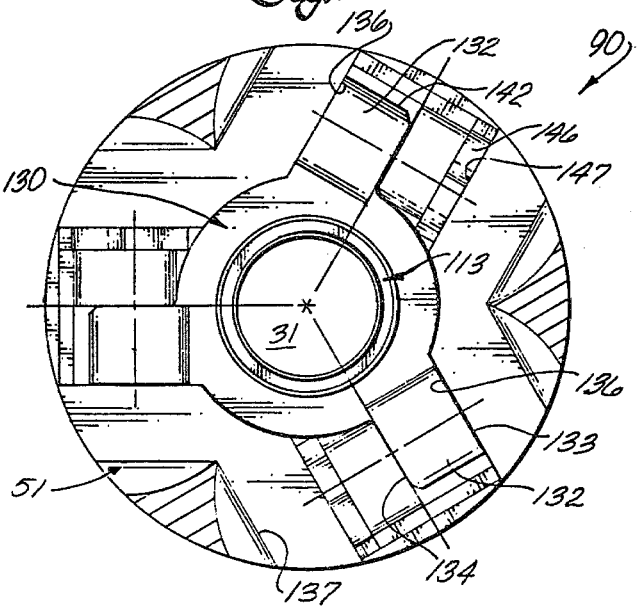
FIG. 4 is a cross-section view taken along line 4—4 in FIG. 3.
Figure 3:
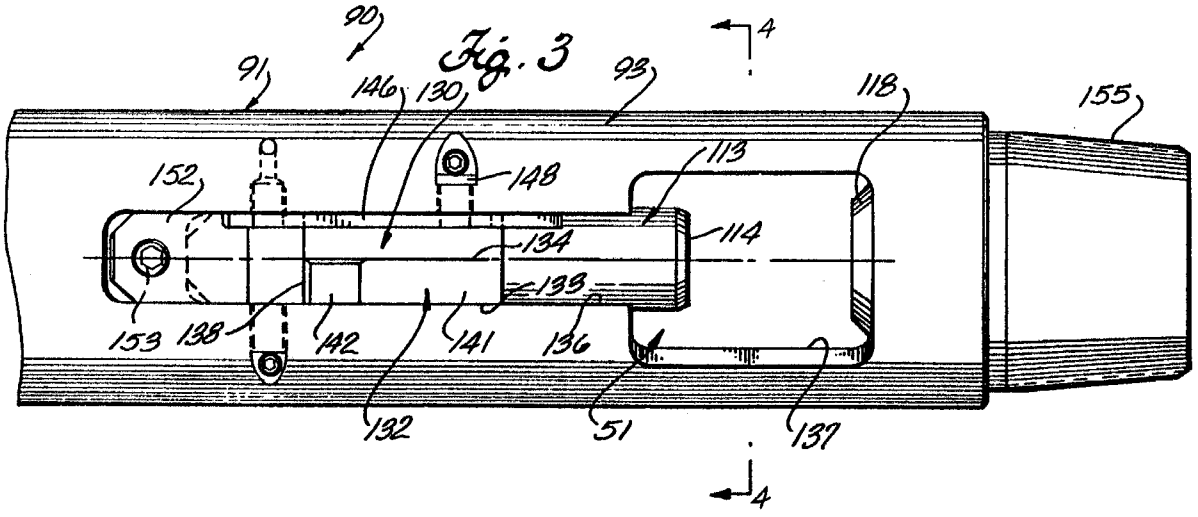
FIG. 3 is a fragmentary elevation view of the portion of the underreamer shown in FIG. 1A.

A cam ring 130 is carried by the exterior of cam sleeve 113 adjacent its lower end. The cam sleeve is shown in longitudinal cross section and in elevation in FIGS. 1A and 4, respectively. The cam ring is removably secured to the cam sleeve by a bayonet coupling. As shown best in FIG. 4, the cam ring defines three outwardly extending cam lobes 132 at equidistantly spaced locations about its circumference. There is one cam lobe provided for each of the three cutter support arms 115 in underreamer 90; the cutter support arms are located at equal intervals angularly around the circumference of the underreamer. (FIG. 1A should not be interpreted as meaning that the two cutter support arms shown there are disposed diametrically opposite each other in the underreamer body. The upper and lower portions of FIG. 1 are mirror images of each other, and differ from each other only to the extent necessary to illustrate the two different basic operative states of the underreamer.) Cam lobes 132 do not extend truly radially from the axis of the cam ring, but extend parallel to a radius of the cam ring. Each cam lobe has a left side face 133 and a right side face 134, as shown in FIG. 4, the right side face being disposed in a plane radially of the cam ring. The distance between the left and right side faces of each cam lobe is approximately one-half the width of the upper portion 136 of the corresponding support arm recess 51 within which the corresponding arm is disposed in the closed position of the underreamer. (The width of the recess is the dimension of the recess about the circumference of the underreamer body.) As shown in FIG. 3, each arm support recess has a relatively narrow upper portion 136, within which the upper and major portion of the length of the arm is disposed, and a larger lower portion 137 within which cutter element 45 is disposed when the underreamer is closed. The left side face 133 of each cam lobe substantially abuts the left side wall of the upper portion of the corresponding support arm recess.

Each cam lobe has an upper end face 138 which is perpendicular to the axis of the underreamer and which is coplanar with the upper end of the cam ring.

The left portion of the inner face of each cutter support arm 115, immediately adjacent to the upper portion of the arm where it journals hinge pin 117, is recessed to define a cam follower surface 140; the inner face of the cam support arm is that face of the arm which is disposed toward the center line of the underreamer when the underreamer is closed. Each cam follower surface 140 is configured to cooperate with a relatively moderately sloped arm-driving ramp surface 141 on the adjacent cam ring lobe. Each ramp surface 41 faces downwardly and outwardly of the underreamer; at its upper end, it connects to an armholding surface 142 which is disposed parallel to the underreamer axis. Each cam follower surface has its greatest spacing from the underreamer axis at its upper end, from which location it curves gradually through a driving portion 143 to a holding surface portion 144 which is defined to be parallel to the axis of the underreamer when the arm is in its fully opened position.

A stop surface 145 is defined in each arm adjacent the corresponding hinge pin in association with the corresponding cam follower surface. Each stop surface 145 faces along the length of the cutter support arm and is disposed perpendicular to the underreamer axis when the cutter support arm is retracted. Each stop surface 145 cooperates with upper end surface 138 of the corresponding cam ring lobe to define the upper limit of travel of cam sleeve 113 in the underreamer when the underreamer is closed. Such cooperation also holds the cutter suport arms from swinging outwardly from their retracted positions when the underreamer is closed. This action is accomplished by the upward force applied to the cam sleeve by the piston bias spring.

A stop plate 146 is located in each cutter support arm recess and is positioned against the right wall 147 of the recess (see FIG. 4 at the one o'clock position, for example). The stop plate is drilled at its upper end to journal the adjacent arm hinge pin 117 and is tapped adjacent its lower end for threaded cooperation with a holding bolt 148 in the manner shown in FIG. 3. The stop plate is thus held secure against the side wall of the upper portion 136 of the support arm recess and held secure from motion relative to that wall. The stop plate defines a stop finger 86 which extends downwardly from the lower outer portion of the stop plate. The stop finger cooperates with a stop projection 84 defined by the adjacent side of the corresponding support arm. The cutter support arm is thus limited in the extent to which it can pivot outwardly from the underreamer axis about its hinge pin in response to cooperation between the cam lobe surfaces and the respective portions of cam follower surface 140.

The upper end surface 150 of each cutter support arm is defined as a portion of the right circular cylinder disposed concentric to the axis of the corresponding hinge pin. This surface cooperates with a respective flat surface 151 formed in the exterior of cam sleeve 113. The radius of curvature of surface 150 is essentially equal to the distance from surface 151 to the axis of the corresponding arm hinge pin. Accordingly each support arm end surface 150 and the corresponding flat surface 151 function as key and keyway, respectively, to prevent rotation of cam sleeve 113 about underreamer axis 94 once the underreamer has been fully assembled. The prevention of rotation of the cam sleeve about the underreamer axis is desired because the cooperation between cam ring 130 and the several cutter support arms is via individual cam lobes 132 which are formed only locally of the circumference of the cam ring, rather than entirely about the circumference of the cam ring. The cooperation between surfaces 150 and 151 to secure the cam sleeve from rotation about the underreamer axis is illustrated best in FIG. 2.

A closure and support arm bearing plug 152 is fitted into the upper end of the upper part 136 of each arm support recess 51 of underreamer 90 between the upper end surface 150 of the adjacent support arm and the adjacent upper end wall of the recess. Each plug is held in position in the underreamer body by a bolt 153 which is threaded into piston and arm sub 93 as shown in FIG. 1A. The lower end surface of each plug 152 is arcuately curved to cooperate closely with a support arm end surface. In this way the forces applied upwardly along the extent of each cutter support arm as the underreamer is operated in its open condition are transferred via plugs 152 to the underreamer body rather than being borne entirely by hinge pins 117. In view of this arrangement the hinge pins function principally as fulcrums affording pivotal movement of the cutter support arms relative to the underreamer body.

The extreme lower end of the underreamer body is externally threaded as at 155 to define the pin portion of a conventional pin and box threaded connection of the type which is typically encountered in equipment used in the drilling of oil and gas wells. The lower end of the underreamer is thereby adapted to be connected to another underreamer 90, to a rotary cone drill bit, or to any other desired component of a drill string.

In underreamer 90, cutter elements 45 are provided as rotary cutter cones of the type which are encountered in rotary cone drill bits, for example. There are three different cutter cones in underreamer 90, one associated with each cutter support arm. Each cutter cone is disposed to have its heel disposed adjacent the lower end of the support arm. Each cutter cone is rotatably mounted to the support arm by suitable bearings, not shown, so that the cutter cone rotates about its axis of symmetry. Each cone has a nose at its apex.

As illustrated in FIG. 1A, the retracted position of the cutter support arms corresponds to the upward position of the cam sleeve. When the cam sleeve is in its upper unactuated position in the underreamer, its lower end is disposed above the retracted positions of the cutter cones. Accordingly, the cutter cones can be sized so that their noses are disposed essentially along the underreamer axis when the cones are retracted into the body. This means that in underreamer 90 larger size cutter cones, of a size heretofore encountered only in rock-type underreamers, are used.

Underreamer 90 is opened, held open, and closed by differential forces derived from the pressures encountered in piston chamber 110, on the one hand, and fluid pressures otherwise applied to the underreamer structure, on the other hand. As described above, underreamer 90, by virtue of the provision therewith of reverse circulation cross-over sub 92, is arranged to be used with a double-wall drill pipe in drilling processes involving reverse circulation of fluid through underreamer flow passage 31. Assume that the underreamer has been connected at the desired location in a drill string composed principally of double-wall drill type 98 and is being lowered into the borehole to the position where underreaming is to be performed. Typically the borehole will be filled with liquid circulating fluid which, in the case of reverse circulation operations, usually is water. As the underreamer is lowered into the borehole, this water will enter into the interior of the underreamer to fill flow passage 31 and axial flow passage 103 in the double-wall drill pipe. In order that reverse circulation can be initiated, air is applied under pressure to outer annular flow passage 104 in the double-wall drill pipe. This air is injected into the water column in the underreamer and the drill pipe via air injection ports 155 formed for this purpose through cam sleeve extension 119 at such location that the ports are closed from the piston chamber 110 by a pair of seals 156 (cooperating between the lower portion of sleeve 106 and the exterior of the cam sleeve extension) when the cam sleeve is at its upper limit of travel but which are positioned to be below the seals and in communication with the piston chamber when the cam sleeve is at its lower limit of travel in the underreamer. The air pressure in drill string passage 104 is also used to actuate the underreamer from its closed state to its opened state. Such air pressure is communicated to piston chamber 110 via filters 109 and actuator flow passages 108 in the reverse circulation cross-over sub.

The pressure which is generated in the outer flow passage of the double-wall drill pipe to initiate reverse circulation of circulating fluid up through the drill pipe is sufficiently great, in combination with the effective area of piston upper face 121, as compared to the pressure of circulation fluid applied to other portions of the cam sleeve, to create a differential force acting downwardly on the cam sleeve. This differential force is greater than the force required to deflect piston bias spring 129 by an amount equal to the desired downward travel of the cam sleeve. Accordingly, the pressures applied to initiate reverse circulation are also effective to operate the underreamer from its closed to its opened state.

Once the underreamer has been operated to its opened state, the lower end of the cam sleeve is abutted with the upper end of seal protector sleeve 32. When such abutment occurs, the effective area to which fluid pressure outside the underreamer can be applied is reduced. Thus, the pressure-oriented forces acting upon the cam sleeve to drive it upwardly in the underreamer are reduced. This reduction is more than the effective reduction in force applied to the upper face of the underreamer piston once reverse circulation is actually initiated in the drill pipe above the underreamer. For this reason, the underreamer is held open by a downwardly effective differential force derived from fluid pressures applied to the cam sleeve as underreaming occurs, regardless of the nature of the equipment present in the drill string below the underreamer.

Once underreaming has been completed over the desired length of the borehole of interest, all that is necessary to cause the underreamer to be operated from its opened to its closed state is to significantly decrease the pressure of air applied to the outer flow passage in the double-wall drill pipe. In other words, once underreaming has been completed, reverse circulation of drilling fluid up through the double-wall drill pipe is terminated. Reverse circulation is effectively terminated by venting the outer flow passage of the drill pipe to atmosphere. The differential forces applied to the cam sleeve, in cooperation with the constant upward bias applied to the underreamer piston by spring 129, are then effective to drive the cam sleeve to its upper limit of travel within the underreamer. As this occurs the underreamer cutter support arms swing, under the influence of gravity, inwardly toward the axis of the underreamer to their "home" positions where they are held by cooperation between cam lobe upper surfaces 138 with stop surfaces 145. As the underreamer piston 120 moves upwardly in the piston chamber, air present in the chamber is expressed therefrom through passages 108. Reverse flow of air through filter element 109 tends to clean the filters of any particulate matter which may have accumulated thereon as the underreamer was opened or during its operation in its opened state.

Figure 5:
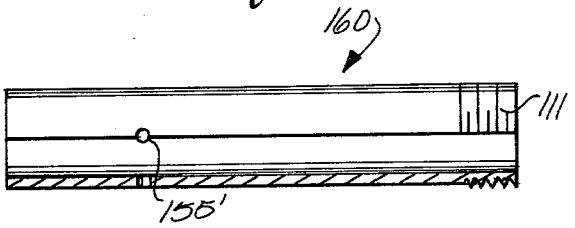
FIG. 5 is an elevation view of another ported cam sleeve extension for the underreamer.

Air injection ports 155 are defined in cam sleeve extension 119 which is removably connected, as by threads 111, to the cam sleeve 113 which carries piston 120. The cam sleeve extension slidably cooperates in the axial bore of reverse circulation cross-over sub 92 which is itself disconnectible via threads 95 from the remainder of the underreamer body. Connections 95 and 111 thereby provide for ready access to the cam sleeve extension so that the extension may be changed to adapt the underreamer for use in any specific reverse circulation application desired. To enable such adaptations to be made, usually by the manufacturer of the underreamer who typically rents or leases such tools, an inventory of alternate interchangeable cam sleeve extensions is maintained. A cam sleeve extension 160 alternate to extension 119 is shown in FIG. 5. Cam sleeve extension 160 is indentical to cam sleeve extension 119 except that it defines air injection ports 155' which have a total area different from the total area of ports 155.

As set forth in the preceding description, air pressure in the annular passage of the double-wall drill string is used to actuate the underreamer from its closed to its opened state, to maintain the underreamer in its open state, and to initiate and maintain reverse circulation. In order that the air pressure can serve all these functions, the total area of ducts 108 effectively open to piston chamber 110 is substantially larger than the total area of the air injection ports formed in cam sleeve extensions 119 or 160 so that the air injection ports serve as air metering orifices for air in the piston chamber at or above a selected minimum pressure. The minimum pressure of air supplied to the piston chamber is selected to be high enough, even considering the bleed of air from the chamber once the ports open by movement below seals 156, to be adequate to drive the piston downwardly in the underreamer to open the tool and to hold the tool in its opened state. The actual total area of the air injection ports in any ported cam sleeve extension is defined relative to this minimum charging air pressure to cause air to be metered into the underreamer axial flow passage 31 at a mass flowrate which is correct for a particular reverse circulation situation with reference to which a particular cam sleeve is selected and installed in the underreamer. For example, the air pressure applied to the piston chamber may be 25 psi or more greater than the greater of the pressures needed for reverse circulation air pressure or the pressure needed to open and hold open the underreamer. The total effective air flow area of ducts 108 may be on the order of 3 to 5 square inches, whereas the total area of the largest air injection ports may be about $\frac{1}{2}$ square inch.

Air injection ports 155 are formed through the cam sleeve extension so that they pass below seals 156 in the terminal portion of the movement of the cam sleeve from its upper to its lower position in the underreamer. For example, the ports may be located so that they open to the piston chamber when the cam sleeve is about $\frac{7}{8}$ of the way from its upper position to its lower position. Seals 156 are spaced along the underreamer axis sufficiently that the distance beween the seals is at least as great as the diameter of the largest air injection ports defined in a cam sleeve extension for the underreamer.

The location of the reverse circulation air injection ports in cam sleeve extension 119, 160, etc., rather than in a joint of the double-wall drill pipe, provides several advantages. The location of the ports in a drill string joint requires the creation and maintenance of an inventory of expensive joints having different port areas. The use of ported cam sleeve extensions makes it possible to transfer the burden of inventory to the underreamer maker or lessor, which inventory is now composed of much smaller and far less costly elements. Also, if the air injection ports are in the drill string near or at the bottom of the string, at least a portion of the annular passage in the drill string will fill with water, which may contain sediments, before air injection is begun. This means that the annular passage will have to be purged of water at least to the level of the ports before reverse circulation can be initiated. Any sediments in the water in the drill string annular passage can and will fall to chamber 105 of the underreamer where they can enter and perhaps clog filters 109 and passages 108. However, where the air injection ports are formed through the underreamer cam sleeve extension, the drill string annular passage and passages 108 can be kept dry at all times. Upon venting the annular passage to atmosphere to enable closure of the underreamer, the air in the piston chamber will be forced out the injection ports until the ports pass above seals 156. No water can enter the piston chamber at any time.

As set forth above, the present invention involving the ported cam sleeve extension is preferably practiced in the context of an underreamer which enables large cutter elements, of the size heretofore found only in rock-type underreamers, to be used in a drilling-type underreamer having an axial flow passage from end to end when the underreamer is opened. This advantage follows from the fact that the lower end 114 of cam sleeve 113 moves, on opening of the tool, from above to below the "home" position of the cutter elements, thus allowing the cutter elements to extend to the tool axis in their "home" position when the tool is closed. As a result, underreamer 90 combines all of the advantages of rock-type and drilling-type underreamers without the disadvantages of either type.

The nature of the bayonet coupling of cam ring 130 to cam sleeve 113 is defined with respect to the usual direction of rotation of the underreamer in use. The forces applied to the cam ring by the cutter support arms are effective to drive the cam ring into, rather than out of, its bayonetted connection to the cam sleeve.

The bayonetted connection of the cam ring to the cam sleeve in underreamer 90 greatly facilitates the adjustment or modification of the underreamer to vary its effective size when opened. Such alteration of the effective expanded size of the underreamer is accomplished merely by changing the cam ring and stop plates for other elements of like type but different geometry arranged to drive the cutter support arms to different opened positions in response to downward movement of the cam sleeve in the underreamer.

Figure 6:
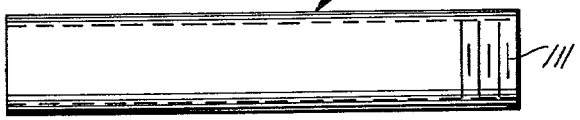
FIG. 6 is an elevation view of an unported cam sleeve extension of the underreamer.

It is a simple matter to adapt reverse circulation underreamer 90 for use with conventional circulation processes simply by replacing reverse circulation crossover sub 92 by a sub which provides communication of piston chamber 110 to the upper portion of underreamer flow passage 31, and by inserting in place of cam sleeve extension 119 an unported cam sleeve extension 165 as is shown in FIG. 6. For conventional circulation processes to be used in connection with underreamer 90, the only additional change which must be made to the structure of the underreamer, as described above, is the provision of some mechanism to generate sufficient pressure-related downwardly-acting force differential on the cam sleeve to cause the cam sleeve to be driven from its upper to its lower limit of travel in the underreamer. Once the underreamer has been operated to its opened state, sufficient downwardly-acting pressure-related forces will be applied to the cam sleeve to maintain the underreamer in its opened state during the continuance of conventional circulation through the underreamer.

One effective way of providing the appropriate force differential, sufficient to cause the underreamer to open in response to fluid pressures encountered in conventional circulation, is to equip the underreamer with a FLO-TEL pin. A FLO-TEL pin is a pin which would be held by suitable spider arms along the axis of the underreamer cam sleeve in fixed relation to the underreamer body, or to the body of a sub connected to the underreamer in place of sub 92, to extend into the upper end of the cam sleeve along the portion of axis 94 which is traversed by the upper end of the cam sleeve in moving from its upper limit of travel to that point in its motion where its lower end first engages the upper end 39 of seal protector sleeve 32. This arrangement will generate sufficient downwardly effective differential force on the cam sleeve to cause it to be operated from its upper to its lower positions in the underreamer. Downward motion of the cam sleeve in the underreamer body after engagement of the lower end of the cam sleeve with the seal protector sleeve will continue because, once such engagement has occurred, the downwardly acting differential forces on the cam sleeve, due to circulation fluid pressures, will be great enough to continue to drive the cam sleeve downwardly in the underreamer even after the upper end of the cam sleeve has passed the lower end of the FLO-TEL pin.

A further advantage of this invention is thus apparent. By the use of an inventory of different ported cam sleeve extensions and unported extensions, and by the use of subs providing communication from piston chamber 110 to passage 31 above the cam sleeve extension in place of sub 92, a basic underreamer structure can be used to service a very wide range of reverse circulation and conventional circulation usages. The economies and efficiencies of manufacture and supply of such tools are readily apparent.

The present invention involving cam sleeve extensions in axial flow underreamers can be practiced in underreamers different from underreamer 90 and having different cutter support arm arrangements and different cutter support arm drive mechanisms. The invention can be used in underreamers in which a cam sleeve or similar element is driven upwardly rather than downwardly, to cause the tool to open. It can be used in tools other than underreamers, if desired.

Workers skilled in the art to which this invention pertains will appreciate that the preceding description of some embodiments of this invention including the presently preferred embodiment, has been set forth by way of example rather than as an exhaustive catalog of all forms which this invention may take. The preceding description has been set forth in compliance with prevailing practice and statutory requirements. The presently known best mode for practicing this invention is reflected by the structure of underreamer 90. Modifications, alterations and variations in the structures and arrangements described above may be practiced without departing from the scope of this invention. Accordingly, the foregoing description should not be considered as limiting the scope of this invention.

What is claimed is:

1. A borehole underreamer comprising a tubular body adapted at an upper end thereof for coaxial connection to a rotary drill string, cutter means mounted to the body for motion relative to the body between retracted and opened positions respectively inside and outside the outer diameter of the body, a cutter means actuator including a tubular element having an open upper end and at least one opening to the interior thereof at a location therealong below the upper end thereof for flow of circulation fluid through the opening and along the interior of the tubular element during use of the underreamer, the tubular element being movable coaxially in the body between upper and lower positions corresponding to the retracted and opened positions of the cutter means with the upper end thereof slidable in an axial bore in the body above an annular chamber about the element so defined that the outer surface of the tubular element defines at least a portion of the inner wall of the chamber, a piston face carried by the tubular element in the chamber below the upper end of the tubular element, duct means in the body having lower ends opening to the chamber and upper ends opening above the upper end of the tubular element in the upper position thereof for communicating to the chamber and to the piston face actuation fluid pressure applied in use of the underreamer to the upper end of the body via a drill string, and port means of selected total area defined through the tubular element at such location therealong relative to the piston face that the port means are closed from the chamber when the element is in its position corresponding to the retracted position of the cutter means and communicate from the interior of the element to the chamber when the element is in its position corresponding to the opened position of the cutter means for flow of actuation fluid into the interior of the tubular element from the chamber in the openend position of the cutter means.

2. Apparatus according to claim 1 including seal means cooperating between the body and the exterior of the tubular element at such location that the seal means are disposed between the port means and the piston face in the position of the tubular element corresponding to the retracted position of the cutter means and the port means are disposed between the seal means and the piston face in the position of the tubular element corresponding to the opened position of the cutter means.

3. Apparatus according to claim 2 wherein the port means are defined at such location along the tubular element that they move to between the seal means and the piston face in the terminal part of motion of the tubular member in movement of the member to its position corresponding to the opened position of the cutter means.

4. Apparatus according to claim 1 wherein the tubular element has a port portion thereof defining the port means which is removably connected to a remainder portion of the element by which the piston face is carried.

5. Apparatus according to claim 4 wherein the total effective area of the duct means to the chamber is substantially greater than the total area of the port means.

6. Apparatus according to claim 5 wherein the tubular element port portion is a first port portion member, and including at least one additional tubular element port portion member interchangeable in the underreamer with the first port portion member, each additional member defining port means therethrough at locations therealong corresponding to the location along the first member of the port means therethrough, the total area of the port means of each additional member being different from the total port means area of the first member and different from the total port means area of each additional member.

7. Apparatus according to claim 6 including a further additional tubular element member interchangeable with the first port portion member but having no port means therethrough.

8. Apparatus according to claim 1 wherein the body is adapted at its upper end to be coupled to a double-walled drill string having an axial flow passage and an annular flow passage circumferentially of the axial passage, and wherein the body duct means are defined to open at their upper ends to the drill string annular flow passage, the upper end of the tubular element opening via the body bore to the drill string axial flow passage.

9. Apparatus according to claim 1 wherein the upper and lower positions of the tubular element correspond respectively to the retracted and opened positions of the cutter means, the piston face opens upwardly in the body, and the port means are defined through the tubular element between the element upper end and the piston face.

10. In a borehole underreamer having a tubular body coaxially connectible at an upper end thereof to a rotary drill string, cutter means movable relative to the body between retracted and opened positions respectively inside and outside the exterior of the body, a cutter means actuator including a tubular element having an open upper end and at least one opening to the interior thereof at a location therealong below the upper end thereof for flow of circulation fluid through the opening and along the interior of the tubular element during use of the underreamer, the tubular element being movable coaxially in the body between upper and lower positions corresponding to the retracted and opened positions of the cutter means and having an upper end portion slidable in an axial bore in the body above an annular chamber about the element so defined that the outer surface of the tubular element defines at least a portion of the inner wall of the chamber, a piston face carried by the tubular element circumferentially thereof in the chamber below the upper end of the tubular element, and duct means in the body having lower ends opening to the chamber and upper ends opening above the upper end of the tubular element in the upper position thereof for communicating to the chamber and to the piston face actuation fluid pressure applied in use of the underreamer to the upper end of the body via a drill string, the improvement comprising port means of selected total area defined through the tubular element at such location therealong relative to the piston face that the port means are closed from the chamber when the element is in its position corresponding to the retracted position of the cutter means and communicate from the interior of the element to the chamber when the element is in its position corresponding to the opened position of the cutter means for flow of actuation fluid into the interior of the tubular element from the chamber in the opened portion of the cutter means.

11. A borehole tool having an axial liquid flow passage therealong and operable between actuated and unactuated states, the tool comprising an actuator which includes an axially movable tube defining at least a portion of the passage and carrying an annular piston movable with the tube in an annular piston chamber formed about the tube so that a portion of the tube defines the inner wall of the chamber, said piston being driven by piston driving fluid, said portion of the tube defining ports therethrough which cooperate with seal means relative to which the tube is axially movable, the seal means being disposed relative to limits of travel of the tube corresponding to the actuated and unactuated states of the tool to close the ports from the chamber when the tube is at its limit corresponding to the unactuated state of the tool and to open the ports to the chamber to divert at least some of the driving fluid directly into the axial liquid flow passage when the tube is at its limit corresponding to the actuated state of the tool, the tool including means for communicating piston driving fluid to the chamber in at least the unactuated state of the tool.

12. A borehole tool having an axial liquid flow passage therealong and operable between actuated and unactuated states, the tool comprising an actuator including an axially movable tube defining at least a portion of the passage and having limits of travel corresponding to the actuated and unactuated states of the tool, an annular piston chamber formed about the tube so that a portion of the tube defines the inner wall of the chamber, said piston being driven by piston driving fluid, an annular piston movable with the tube and disposed in the piston chamber, seal means cooperating with the exterior of the tube, fluid flow ports through the tube, the seal means and the ports being so disposed relative to each other and to the tube limits of travel that the seal means close the ports from the piston chamber when the tube is at its limit corresponding to the unactuated state of the tool and the ports are open to the piston chamber for diverting at least some of the driving fluid directly into the axial liquid flow passage, when the tube is at its limit corresponding to the actuated state of the tool, the tool also comprising means for communicating piston driving fluid to the piston chamber in at least the unactuated state of the tool.

13. Apparatus according to claim 12 including a body, the body defining the piston chamber and carrying the seal means.

14. Apparatus according to claim 12 wherein the tool is a borehole underreamer.

* * * * *